US007351154B2

(12) United States Patent
Müller et al.

(10) Patent No.: US 7,351,154 B2
(45) Date of Patent: Apr. 1, 2008

(54) FUN-RIDE AND A METHOD FOR THE OPERATION OF A FUN-RIDE

(75) Inventors: Alfred Müller, Gröbenzell (DE); Jörg Beutler, Holzkirchen (DE)

(73) Assignee: Maurer Sohne GmbH & Co., KG, Munich (DE)

( * ) Notice: Subject to any disclaimer, the term of this patent is extended or adjusted under 35 U.S.C. 154(b) by 155 days.

(21) Appl. No.: 11/124,735

(22) Filed: May 9, 2005

(65) Prior Publication Data

US 2005/0288109 A1 Dec. 29, 2005

(30) Foreign Application Priority Data

May 7, 2004 (EP) ..... 04010936

(51) Int. Cl.
*A63G 21/04* (2006.01)

(52) U.S. Cl. ..... 472/43; 104/55; 104/63

(58) Field of Classification Search ..... 472/29, 472/36, 39, 45, 46, 43; 104/53, 55, 58, 66, 104/89, 91, 92
See application file for complete search history.

(56) References Cited

U.S. PATENT DOCUMENTS 4,165,695 A * 8/1979 Schwarzkopf ..... 104/55
5,433,153 A * 7/1995 Yamada ..... 104/63
5,463,962 A * 11/1995 Gnezdilov ..... 104/55
6,348,004 B1 2/2002 Houben
6,792,873 B1 * 9/2004 Gnezdilov ..... 104/53
6,854,396 B2 * 2/2005 Roodenburg et al. ..... 104/53
6,857,373 B2 * 2/2005 Checketts et al. ..... 104/53

FOREIGN PATENT DOCUMENTS

DE 481 377 8/1929
DE 203 16 345 4/2004

* cited by examiner

*Primary Examiner*—Kien T Nguyen
(74) *Attorney, Agent, or Firm*—Pearne & Gordon LLP

(57) ABSTRACT

A fun-ride more particularly for amusement parks, fairs and the like comprises at least one rail vehicle 1 and a guide lap for the vehicle 1. In a lateral projection a lap section 2 of the guide lap essentially constitutes a loop, the lap section 2 comprising a first uphill section 3 and a second downhill section 4 and the top ends of the sections are connected together. At least in the uphill section 3 the means 5 for engagement with the vehicle 1 is arranged. This means may for example be a holding brake or a coupling device. It is preferably operated when the vehicle 1 comes to a halt after a downward movement owing to the action of gravity on the vehicle 1. Accordingly a method for the operation of such a fun-ride comprises the steps of: transport of the vehicle 1 from a starting point 3*a* and 4*b* in the bottom portion of the lap section 2 by means of a lift upward; release of the vehicle 1 from the lift, which the owing to the action of gravity performs a downward movement; activation of the means 5 for engagement with the vehicle 1, when same is in the vicinity of the means 5; and further transport or return transport of the vehicle 1 to the starting point 3*a* and 4*b* by means of a transport means.

47 Claims, 5 Drawing Sheets

FUN-RIDE AND A METHOD FOR THE OPERATION OF A FUN-RIDE

The invention relates to a fun-ride, more particularly for amusement parks, festivals and the like, comprising at least one rail vehicle and a guide lap for the vehicle with a lap section, which in a lateral projection essentially constitutes a loop, the lap section having a first ascending section and a second descending section, the top ends of the sections being connected together. Furthermore, the invention relates to a method for the operation of a fun-ride.

In amusement parks, at carnivals and festivities fun-rides have long belonged to the principal attractions. Owing to competition between the individual fun-rides and in view of the higher standards expected by passengers novelties are being continuously introduced in order to attract as many passengers as possible and to awaken the attention of potential customers. In this respect both the general appearance of the fun-ride and also the types of motion involved are important.

For this purpose laps with more and more elements and steadily increasing complexity of design are being offered in order to give the passengers more thrills. The passenger is to have the possibility of enjoying a motion effect as copiously and as realistically as possible. The tracks are thus made higher and higher with an increasing rail length. Frequently it is necessary for the potential energy to be dissipated by braking. The result is higher costs for the installation and operation of the system.

Accordingly both the work involved during erection the space requirement and furthermore the complexity of operation of the fun-ride are increased. More particularly, when space available or the time allowed for erection is limited it is frequently not possible to provide tracks which satisfy the expectations of the passengers as regards thrills and fun.

More especially in the case of long laps several vehicles will be under way simultaneously in order to ensure profitable use of the system. In addition to the above mentioned need for increasing complexity of design of the lap configuration there is therefore the need for more involved safety systems, as for example means preventing reverse movement in the trains, which on motor brake failure, chain breakage or the like take effect to prevent danger to passengers by the use of block brakes, more complex controls or the like. Consequently there is a further substantial increase in costs.

Shuttle rides are also known, in which the ride along a track section is repeated a number of times. In the case of such fun-rides, as for instance in a "half pipe" the vehicles pendulate along a track. The drives of such tracks may be of different types. In one version the vehicle is towed upward and released at the highest position. In another version the vehicle is slowly pendulated upward by a drive in the station zone. The vehicle can also be got going by a launch system. In the case of such systems a separate braking and positioning device is necessary to retard the vehicle in the station and to position it. The drive is generally also employed for braking, usually in several pendulations. However, such fun-rides are not very attractive, since the same operation is repeated over and over again without any variety.

Taking these systems as a starting point one object of the invention is to provide a fun-ride and a method for the operation thereof; with which thrilling motion effects may be produced without substantial complexity of the device and its operation. Furthermore, the fun-ride is to present an attraction for the eye.

This object is to be achieved by the fun-ride in accordance with one of the claims 1, 2 and 10 and by a method for the operation of a fun-ride in accordance with claim 26.

The fun-ride, more particularly for amusement parks, public fairs and the like comprises at least one rail vehicle and a guide lap for the vehicle with a lap section, which in a lateral projection essentially constitutes a loop. The word loop here means every arrangement of the guide elements in the lap, which in its lateral or in an oblique projection or view represents an endless track. This may be a circle-like track configuration, though it is also possible to have a substantially different configuration. Furthermore, the fun-ride may be fitted either with a vertically arranged uphill flight and a lift or with an oblique uphill flight and an oblique lift. The lap section comprises a first ascending section and a second descending section. The top ends of the sections are connected together. The vehicle is able to be moved along the side, facing the inner side of the loop, of the sections. As a rule the result is a track as for a loop-the-loop maneuver. At least in the first ascending section the invention provides a means for engaging the vehicle for the vehicle. The means for engaging the vehicle for the vehicle may be any suitable type of brake, in the following referred to as a holding brake, or a coupling device, which again may be at least functionally connected with a transport means. At any rate the means must in accordance with the invention engage a vehicle. Such engagement is to be understood in the sense of "acting" so that it is not necessarily a question of physical contact: it may for example also be a question of an eddy current brake as a means within the meaning of the invention.

The vehicle may after one or several pendulations be coupled with a transport means provided for this purpose, for instance a lift and more particularly a chain or a transport slide. The means for engagement with the vehicle may be any suitable type of coupling device, as for example a part of a transport means.

One advantage of the fun-ride resides in the dimensionally extremely compact arrangement on a small base area, a substantial attractiveness for the passengers of the vehicle and spectators being maintained. The arrangement may be produced and erected at low costs. The arrangement renders possible for example a lift exit in an inverted position, i.e. the heads of the passengers are directed downward in the exit from the first into the second section after braking. Owing to the design of the fun-ride multiple rides through a particular section may be undertaken to provide a great variety, as for example including a slow run with a lift, on whose chain the vehicle is coupled, out of the vicinity of the means for engagement with the vehicle, through the exit into the second section out of the lift in an inverted position, by plunging and ascending, by inversion and pendulating back, by renewed pendulating forward as far as the means for engagement with the vehicle, by renewed upward riding with a start at a great height and by repeating such a cycle. The number of the pendulations may be freely selected. An additional thrill for the nerves is produced by the being "left hanging", as experienced by vehicle occupants, at a substantial height on "stalling" the vehicle by the means of engagement on the vehicle and by the wait phase until the lift is coupled for further transport. As an alternative the vehicle, after being held by the means, may be transported downward at a high acceleration rate before it rides upward, and vice versa. An additional thrill for the nerves is produced during pendulation to and fro at least one point of reversal may be located at least partly in the inverted position and the vehicle may be retarded relatively slowly in the point of reversal and then accelerated again.

It has already been noted that the space requirement for the fun-ride in accordance with the invention is extremely small. Owing to the compact construction an economic optimum is reached for the steel structure. The lap design furthermore provides a neat, self-containing appearance so that it appeals to the eye.

When only one vehicle is under way it is furthermore impossible for a collision to occur between vehicles and accordingly in this design no block system is necessary.

The fun-ride, more especially for amusement parks, festivals or the like, comprises at least one rail vehicle and a guide lap for the vehicle with a lap section for the vehicles, which in a lateral projection essentially constitutes a loop, the lap section comprising a first ascending section and a second descending section, whose top ends are connected with each other. The vehicle is able to be moved along the side, facing the inner side of the loop, of the sections. A transport means is provided for transport of the vehicle along at least one section part of the guide lap. The transport means is arranged at least in the first ascending section, the transport means having a chain and the vehicle being able to be coupled by means of an entrainment means and/or a chain hook with the chain.

The transport means have a plain chain, as for example an endless chain. A means, as for instance a slide, arranged in a particular lap section parallel to the chain, may be switched in order to put an entrainment means arranged on the vehicle, for instance a chain hook, into engagement with the lift chain. The control of the slide takes place in a manner dependent on the vehicle position and/or vehicle speed. In this case it is not necessary to provide an additional means on the transport means in order to catch the vehicle. In fact coupling may take place in a simple manner with the chain, which in any case is present. Positioning of the transport means is not necessary for coupling. Accordingly the complexity of the control system is reduced. During the procedure time may be saved since no positioning is necessary. More particularly coupling may take place on the go, i.e. without the vehicle being halted. Furthermore the coupling operation is simplified owing to the direct coupling to the transport means.

In one particular design the vehicle may be coupled with the transport means using an entrainment means attached to the vehicle and/or a chain hook.

The transport means may comprise an endless chain. Coupling of the vehicle with the endless chain may be take place at any convenient position.

The lap section, in which the means for engagement with the vehicle is arranged, may be essentially arranged in a vertical plane.

During transition from the first section to the second section the vehicle is preferably in an inverted position.

More especially it is possible for the bottom end of the first section and the bottom end of the second section to be joined together so that the entire lap section constitutes a closed or endless track. In this respect a great variety of track forms is possible without limitation to circular closed track forms. The technical and accordingly also financial involvement may in the case of such design be additionally reduced because the entry to the lift, the station and further associated means are so designed that the ride may be take place along the lap forward and backward without safety problems. Accordingly safety instrumentalities as in other roller-coasters are not required, as for example a reverse movement preventer in the lift, which on failure of the motor brake, chain breakage or the like becomes effective in the lift. The same applies for the safety aspect of all other internal components, as for example the means for engagement with the vehicle. More particularly with this design no internal part has a safety function, since a "crash dive" of the vehicle is intentional and accordingly persons can not be endangered.

The guide lap may have a connecting section between the first and the second section, which is so twisted that the vehicle during the ride through the connecting section is turned laterally in a plane substantially perpendicular to the direction of travel. A further important point as regards the economic aspects and utility is the simple way in which it may be enlarged. In order to increase attractiveness ride elements can be incorporated, such as the one already mentioned as corkscrew movement, which is performed by the vehicle without abandoning the basic concept with its properties.

The connecting section may in particular be so twisted that the vehicle on moving through the section performs a corkscrew motion, more particularly one through 360 degrees in all.

A fun-ride with an alternative lap design but with the same basic components, comprising at least one rail vehicle and a guide lap for the vehicle with a lap section, which includes a first ascending and a second descending section, the first and the second section being arranged essentially in parallel and being connected together by an arcuate section, comprises at least one means for engagement with the vehicle, which is arranged in the first ascending section.

The means for engagement with the vehicle is more particularly arranged in an ascending section, in which the vehicle travels at a low speed or is stationary. The means for engagement with the vehicle is preferably arranged in a portion of the first section, in which or above which the vehicle having performed a plunge comes to a halt owing to gravity acting on it.

The means is preferably arranged for engagement of the vehicle in the ascending section in a portion, which is provided for the vehicle to perform a change in direction in such portion or somewhat above such portion.

The means for engagement with the vehicle may be arranged in a portion of the first section, which essentially is free of curvature. This renders possible a minimum of technical complexity. It may however be arranged in a curved section.

This portion may extend essentially vertically upward.

The fun-ride may in addition comprise a conveyor means, the means for engagement with the vehicle being arranged in the vicinity of such conveyor means or functionally coupled with such conveyor means.

The means for engagement with the vehicle is more particularly so designed that in the case of a reversal of the ride direction of the vehicle there is a powerful braking action exerted on the vehicle whereas during an ascending motion of the vehicle on the other hand there is only a slight or no braking action on the vehicle, unless the braking action during ascending travel is to be employed as a special effect. Then as an alternative a brake with a powerful braking force must act during an ascent.

In the bottom portion of the lap section there is generally a station.

The station may with advantage be arranged in a rail portion, which has a lap configuration set by ride dynamics. This means that no special adaptation of the lap configuration in the vicinity of the station is necessary. This applies both for the curvature of the rails and also their directional configuration. The size of the system may thus be minimized. Moreover the comfort of the occupants is increased, since the curvature and the configuration of the track in the case of an adaptation of the lap to the requirements of the station in high centrifugal zones would have to be changed to depart from its "natural" shape or configuration. This would lead to jolting and unexpected movements for the occupants.

The bottom end of the first section and the bottom end of the second section may be offset laterally in relation to each other and the lap section may be integrated within a guide lap with further lap elements. The basic version of the fun-ride in accordance with the invention may be expanded in a simple manner by separating the lap configuration at the station and adding a further lap configuration having additional ride elements. All other means (control, means for engagement of the vehicle and the like) remain the same in the case of the basic version. This design also makes it clear that the basic version of the fun-ride in accordance with the invention may be expanded. As an alternative the rail strand may be separated at the station. Further ride elements may be then added. The ride lap or, respectively, the ride durations may be so increased that it is best to add a block system and a brake before the station, since otherwise there would be a substantial reduction in capacity owing to the longer ride time. With the block system it is now possible for several vehicles or trains to operate on the track. Accordingly with such an enlargement there will be a substantial increase in capacity, for example more than twice as much.

The means for engagement with the vehicle may for example be a coupling means. It may be an entraining means connected with the transport means or a chain hook, which, actuated by a switching slide, which is secured to the ride lap, couples the vehicle with the chain.

The coupling means is preferably at least functionally connected with a transport means, that after coupling with the vehicle can shift the vehicle to the starting point or, respectively, to a station.

The means for engagement with the vehicle may be a holding brake. It can be any suitable type of brake, which is able to be employed in fun-rides. Since the brake is however primarily employed for holding the vehicles and more rarely for braking, it is termed a means for engagement with the vehicle. Owing to its function for holding the brake is substantially wear-free, since the vehicle is already stationary and only has to be held against gravity. The brake is furthermore insensitive as regards variations in the speed of the vehicle on entering the braking zone, which result from natural variations in the resistance to travel.

The means for engaging the vehicle in a resting state may more particularly also be a holding brake.

The holding brake can also be designed as a brake which is self-locking during a descent of the vehicle. In the case of this type of brake the brake need be supplied with only very little external energy or force or with no energy at all, in order to produce the braking force. The brake may furthermore be so designed that the opening mechanism of the brake is driven as long as the vehicle is held by the brake and the brake however does not open as long as the weight of the vehicle acts on it. It is only when, for example the vehicle is unloaded by the lift lifting it, that the brake opens. This opening movement of the brake may simultaneously serve as a signal to indicate that coupling of the lift with the vehicle has been successful.

More particularly the holding brake is so designed that it is only actuated when it is supplied with energy. This means that the brake is open or released in the energyless state. Accordingly steps are taken to see that in the case of a trouble condition the vehicle is not locked at a great height.

The holding brake may be so designed that it only opens, following cessation of the actuating force or energy, when it is unloaded.

A further advantage of the invention is its extremely short brake length, which the holding brake has to have. Braking to a halt generally takes place even prior to entry into the means for holding under influence of gravity so that on entering the means in certain cases only a short braking distance is needed for the vehicle to come to a halt. The same applies in the case of the use of a coupling device instead of a holding brake. For this purpose braking need not precede the coupling operation. Coupling may take place, without a brake, at a relatively low speed or speed differential between the vehicle and the transport means or coupling device.

The method of the invention for the operation of a fun-ride with at least one rail vehicle and a guide lap for the vehicle, which has a lap section with a first ascending section and a second descending section, whose top ends are connected together, a means for engaging the vehicle being provided on the ascending section, comprises the steps of: transporting the vehicle from a starting point to a bottom portion of the lap section by means of a transport means upward; the separation of the vehicle from the transport means, downward movement of the vehicle under the influence of gravity; and actuate of the means for engagement of the vehicle, when the vehicle is in the vicinity of the means.

As a rule the transport of the vehicle upward is performed in a vertically arranged passage within lap section, that is to say by means of a chain lift. In lieu of this however an oblique lift on an oblique upward flicht may be provided. A vehicle, which may comprise a plurality of coupled vehicles or carriages, is accordingly as a rule transported from the station at a low position on the lap by means of the lift and then moves under effect of gravity down the track. In this case the vehicle passes through the station. Owing to resistance to travel involved the vehicle will as a rule no longer reach the top point of the lap and pendulates back. This pendulating or reciprocating operation may be repeated as often as desired. However pendulating until the vehicle halts at its starting point does not add much to the pleasure of a ride and having regard to the resulting decrease in the number of persons it is not to be aimed at owing to the long pendulating phase necessary. Accordingly on the lift side approximately the level of the first and/or second and/or further reversal point a means is arranged for engaging the vehicle, which is operated, automatically or manually, to act on the vehicle approximately in the vicinity of the reversal point,. The engagement with the vehicle may for instance entail holding fast by operation of a holding brake, or coupling by actuation of a coupling device. A substantial advantage of the method is that despite the dimensionally very compact arrangement on a small base area there is a substantial attraction for passengers and an attractive overall appearance of the fun-ride.

The means for the engagement with the vehicle is more particularly operated when the vehicle is in the vicinity of the means for engagement with the vehicle moving at a low speed or is halted. The coupling device therefore couples generally at the instant of reversal of in the direction of motion of the vehicle, or with the chain running at that point in time, at which the chain's speed and the vehicle's speed are approximately equal, by way of a moving hook or the like the vehicle to the chain of the transport means. A holding brake holds the vehicle fast, when same is moving at a low speed or is halted. In this case as well subsequently an additional coupling operation to a transport means may take place. The vehicle is accordingly after a first full lap or after several pendulating movements coupled to a transport means, for example a lift and more particularly a chain or a transport slide.

The vehicle is retarded to the low speed or respectively to a halt in the ascending section more particularly essentially by the action of gravity.

The means for engagement with the vehicle preferably acts on the vehicle generally at a change in direction in the ascending section. The means for engagement with the vehicle is preferably actuated, either automatically or manually, when the vehicle (in the vicinity of the means for engaging the vehicle), retarded by gravity, comes to a halt, or has passed the point of ride direction change already just above the means and is now moving with a low speed downward into the that portion where the means is arranged. A further advantage of this method is that the means is practically free of brake pad wear, since the vehicle does not have to be braked and is only held against gravity or is coupled at a low speed of the vehicle or equal speed of the vehicle and the coupling means. The means is furthermore substantially insensitive to variations in the entry speed of the vehicle, which result from natural changes in the resistance to travel in that portion in which the means for engaging the vehicle is arranged.

The means for engagement with the vehicle more particularly exerts, irrespectively of whether it was actuated, during upward motion of the vehicle, no or only a very slight braking on the vehicle. Accordingly the means, more particularly a brake, may be controlled very simply without any events which have to be accurately timed or involve complex control technology. As an alternative however the means, should an intended ride situation be desired, may be so designed that during an ascent it exerts substantial braking forces on the vehicle, something which leads to a special ride sensation.

After actuation of the means for engagement with the vehicle the latter will only move downward to a slight extent or not all.

After engagement with the vehicle the vehicle will as a rule, after detachment of the transport means, only pendulate under the influence of gravity between the first section and the second section at least once to and for. The pendulating movement will however, as already explained, be interrupted at the right time by the means for engagement with the vehicle in order to maintain the ride pleasure or in order to transport the vehicle on to another lap point.

After the release of the vehicle from the transport means in addition to gravity drives and/or brakes may act on the vehicle in order to additionally accelerate or retard it.

The means for engagement with the vehicle is preferably activated in order to act at the next halt or, respectively, the next downward movement of the vehicle in that portion in which the means is placed. This means that the means may be activated as soon as the vehicle has left the range of action of the means in a downward direction. The actuation of the means or, respectively, its effect then starts at that point in time, at which the vehicle passes through the portion in a downward direction the next time and, respectively, comes to a halt there.

As a rule the vehicle will after actuation of the means be transported downward to the starting point or, respectively, back to a station. The transport means, either the one already mentioned, or a further transport means, couples during or after the action of the means on the vehicle with the vehicle and transports it back to the station. The means in the form of a coupling device may be at least functionally connected with a transport means which moves the vehicle back to the station. One advantage is that it is possible to do without a station brake. The potential energy of the vehicle present at some point high up on the lap is dissipated return movement caused by the transport means.

As an alternative the vehicle after the actuation of the means may be moved on upward at least as far as the entry of the vehicle into the second section or, respectively, in a connecting section between the top end of the first section and the top end of the second section by a transport means. A transport means, possibly the vertical lift or oblique lift described above for upward movement of the vehicle, is coupled during or after the action of the means to the vehicle again and moves it up further in order then to render possible a slow lift exit into the second section or, respectively, into the connecting section. If a coupling device is present it may be at least functionally connected with a conveyor means, which is directly responsible for further transport. Owing to the approach to the "projecting ledge" the thrill for the nerves is increased and owing to relatively slow travel along the highest part of the track an attractive view down onto the station is offered, the vehicle occupants' bodies having an acceleration feeling of approximately 1 g in a downward direction.

In the transition portion between the first section and the second section or, respectively, in the connecting section the vehicle is in an inverted position in which the heads of the occupants are directed downward. This additional measure leads to a further thrilling experience for the occupants. As alternative exits however forward exits are possible. Thus a ride element may include an upward ride section and a downwardly directed section connected with the upward ride section by way of a curve, which can also be arranged essentially in an oblique or vertical plane. The method is not to be limited to particular lap configurations.

In addition the vehicle may be tilted laterally on passing along the connecting section.

The vehicle may perform a corkscrew movement and more particularly a lateral turn through 360 degrees in all.

As a means for engaging the vehicle a coupling device may more especially be provided.

The coupling device may be coupled with the vehicle at, shortly before or shortly after a change in the direction of vehicle travel in the ascending section.

The coupling device is furthermore preferably functionally connected with a transport means, which transports the vehicle after coupling with the vehicle to the starting point or, respectively, to a station. Accordingly it is possible, as already mentioned, to dispense with a station brake.

The coupling device is generally at least functionally joined with a transport means and couple the coupling device with the vehicle at a point in time at which the speed of the transport means and of the vehicle are approximately equal. Control of the actuation of the means is quite simple in this embodiment. The coupling device thus couples at the instant of reversal in the direction of motion of the vehicle or if the chain is running at the instant at which the chain speed and the vehicle speed are approximately equal, by way of an entraining means, by way of a moving chain hook or the like, vehicle to the chain of the transport means.

As a means for engagement with the vehicle it is also possible to provide a holding brake.

The holding brake may more particularly also open, after the cessation of the actuating force or actuating energy, when it is unloaded.

Furthermore the holding brake may, following its activation during a downward movement of the vehicle, act with a self-locking effect.

Further features and advantage of the invention will be seen from the following description of preferred embodiments.

Figure 1:
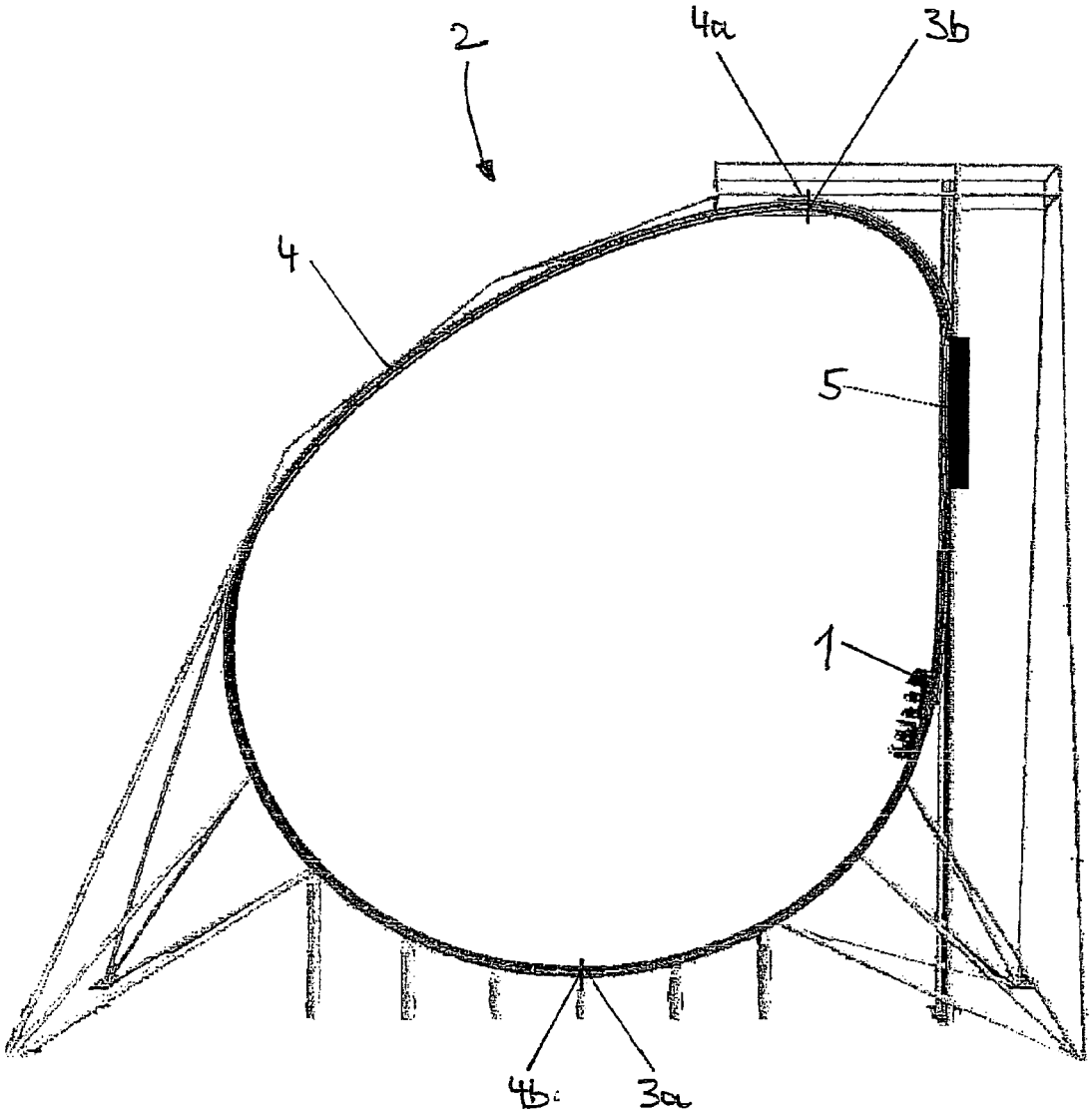
FIG. 1 is a diagrammatic sketch of a basic version of the fun-ride in accordance with the invention in a side view.

FIG. 1 diagrammatically shows the basic structure or, respectively, a basic version of the fun-ride in accordance with the invention. The new type of fun-ride may be named a type of roller-coaster. The fun-ride may in any case offer a pleasurable ride similar to that on a roller-coaster.

The fun-ride comprises a guide lap 2, on which a rail vehicle 1 runs. As shown in figure the vehicle 1 may include several carriages coupled in tandem. A first ascending lap section 3 is delimited by a bottom end point 3*a* and a top end point 3*b*. A second descending lap section 4 is delimited by a top end point 4*a* and a bottom end point 4*b*. The lap section 3 and 4 may also be changed over or may be both termed ascending or descending. Both lap sections 3 and 4 are curved, at least in a section part toward the inner side of the loop. The top and, respectively, bottom end points 3*a*, 4*a*, 3*b*, and 4*b* of the sections 3 and 4 are connected with one another so that generally a closed track or, respectively, lap configuration results.

From the lateral view of FIG. 1 it will be clear that the lap 2 constitutes a closed or completed loop, which is essentially annular with slight bulges. The overall lap section 2 is essentially arranged in a vertical plane. It may however be arranged in an oblique or inclined plane. In principle any lap configuration is possible, which is suitable for the manner of operation in accordance with the invention. The lateral projection of the lap in the arrangement in accordance with FIG. 1 generally represents a loop-the-loop maneuver. The vehicle 1 moves along the side facing toward the inner side of the loop, of the lap 2 and is therefore able to travel along the inner side of the loop.

The first section 3 has, in addition to at least one section part with a positive curvature, i.e. with a curvature toward the inner side of the loop, a non-curved section part extending vertically upward. On this section part a brake 5, which may be termed a holding brake, or a coupling device is arranged. Alternatively to this furthermore a coupling device 5 may be provided which couples to the vehicle as soon as the vehicle moves past the device at a low speed or reverses its direction in the vicinity of device 5, that is to say generally comes to a halt. The brake or, respectively, the coupling device 5 performs an important task in the fun-ride in accordance with the invention. The holding brake or, respectively, the coupling device 5 is arranged in a portion of the first section 3, in which the vehicle 1 during operation comes to a halt at least on travel through it, owing to gravity acting on the vehicle 1. It is also possible to arrange further holding brakes on the lap sections 3 and/or 4 at the level of further (possible) points of reversal which hold the vehicle 1 in the corresponding position on a change in the direction of motion.

During operation the vehicle 1 starts generally at a starting point, for example the bottom apical point 3*a* and 4*b* of the closed track 2. Then it is drawn upward by a vertical lift or oblique lift. Alternative drive possibilities would for example be pendulating of the vehicle 1 between the lap sections 3 and 4 or launching of the vehicle 1 with a launching device. The vehicle in any case gains potential energy on moving upward. A certain point in the track sections 3 or 4 the vehicle may be released. Then it would, if there is no further influence, slowly pendulating owing to natural resistance to travel under the influence of gravity. Then, if no further influence takes effect, pendulation would slowly come to an end between the track sections 3 and 4 owing natural resistance to travel under the effect of gravity. However this would be rather tiring, even if the lap has brakes and accelerating means to influence the pendulating motion.

Accordingly in the invention a vehicle 1, when coming from the apical point 3*a* and 4*b* moves upward f. i. in the section 3 and in the vicinity of the holding brake 5 or, respectively, the coupling device generally halts, since here under influence of gravity a point of reversal is located, by which the holding brake 5 is held fast or, respectively, the coupling device 5 would couple. Owing to the holding brake or, respectively, the coupling device it is therefore possible to select or influence the number of pendulations and furthermore the point in time of the start or continuation of a pendulation operation.

The holding brake 5 or, respectively, the coupling device for engagement with the vehicle 1 is accordingly operated exactly when the vehicle 1 moves at a low speed in the vicinity of brake 5 or, respectively, the coupling device or comes to a halt here. When a coupling device is employed coupling may take place when the vehicle is nearly or completely halted, or, respectively, when the speed of the vehicle and of a conveyor means provided therefor, for example a chain, are approximately equal. Owing to "being left on the lurch" at a great height with the vehicle 1 at a standstill and the wait phase until the lift is uncoupled and the vehicle 1 moves on farther, there is an additional kick for the nerves.

The brake or, respectively, the coupling device is more particularly activated when the vehicle is not to perform any more pendulations.

The holding brake 5 and, respectively, the coupling device may, in order to fulfill their task, be differently designed. In principle the holding brake 4 may be a conventional brake as is employed in fun-rides. Preferably however it is so designed that on reversal of the ride direction of the vehicle 1 it produces a high braking force and during upward movement of the vehicle 1 on the other hand it produces a small or no braking action. After the activation of the holding brake 5 the vehicle is to perform a minimum or only an extremely small downward movement. The holding brake 5 may in a particularly advantageous design be self-locking during a downward movement of the vehicle. For safety reasons it is furthermore expedient to design the brake 5 so that it is only actuated, when it is supplied with energy. Accordingly it is not possible for the vehicle 1 to be held at the holding brake in a trouble condition. Failure of the brake 5 or of the coupling device to function, that is to say "non holding" of the vehicle 1 in a trouble condition, would on the other hand be no problem, since the system is designed for pendulation to and for of the vehicle 1 between the lap sections 3 and 4. One advantage of the holding brake 5 is that it is practically free of brake pad wear. Furthermore it is substantially insensitive to variations in the entry vehicle 1 into the brake 5, which result from natural changes in the resistance to movement and the environment condition. A self-locking holding brake on the other hand is not released even on power failure or in the case of a trouble condition, i.e. to be released it must be unloaded. A coupling device can be at least functionally connected with a transport means, as for example a lift chain. It may be designed as an entrainment means, a moving chain hook or the like.

After taking hold or coupling in the relatively high lap section of the track 2 in the vicinity of the holding brake 5 or, respectively, the coupling device the vehicle is transported farther by a transport means, for instance upward at least as far as the entry of the vehicle 1 into the second section 4. The transport means is as a rule the same lift, which conveyed the vehicle 1 at the start of the upward ride; it may however be designed separately.

An additional kick for the nerves may be achieved if during pendulation at least one reversal point is at least partly in an inverted position and the vehicle is here relatively slowly retarded and then accelerated again.

During the transition from the first section 3 to the second section 4 the vehicle 1 is in an inverted position, i.e. the heads of the occupants of the vehicle 1 are directed downward or are directed obliquely downward. The lift exit is therefore inverted. Owing to approaching the "overhanging ledge" and also the relatively slow passage through this section the passengers will also be given an additional thrill, since they are pulled from their seats by an acceleration of approximately 1 g. During movement through a known, conventional loop-the-loop element an occupant, although he is some of the time upside down, will generally not be subject to any forces drawing him away from his seat (centrifugal force is here larger than the force of gravity) in the guide lap in accordance with the invention on the other hand only relatively small forces raising the speed of travel act. The passenger is made substantially more aware of inversion during the ride and unlike most inversions he will have much more time to savor the situation. Furthermore, a magnificent view from above, at for example approximately 45 meters is offered vertically downward.

Toward the end of the ride the lift may couple with the vehicle held by the holding brake 5 and move it back to the starting point or, respectively, to a station. Alternatively the transport means, including a coupling device, may move the vehicle back, after it has coupled with the coupling device 5 provided in accordance with the invention. The advantage here is that it is possible to do without a station brake since potential energy is taken up by the transport means.

The lap configuration and the design of the fun-ride in accordance with FIG. 1 lead to a compact, neat appearance. In addition the system is able to be produced at low costs while at the same time offering substantial entertainment value and many thrills. Multiple rides full of variety may be provided owing to the measure adopted and more particularly owing to the use of the holding brake 5 or, respectively, the coupling device, for example by the lift ride, by the exit from the lift in an inverted position, reversal and return pendulation, holding fast by the brake or, respectively, coupling device and the like.

The technical and accordingly the financial involvement is reduced since entry into the lift, possibly a station and the associated means are so designed that a ride forward and backward along the lap is without safety problems. Technical safety measures as in other roller coasters are not required as for example roll back prevention means in the lift, which take effect in it on failure of the motor brake, chain breakage or the like.

The same applies as well for safety considerations for all other inner fixtures, as for example the holding brake. No internal fixtures have to perform a safety function, since a crash dive of the vehicle is in fact intended and accordingly no danger to life and limb can take place.

Since only one vehicle is on the circuit, no collisions between vehicles may occur and accordingly not block system is necessary.

Figure 2:
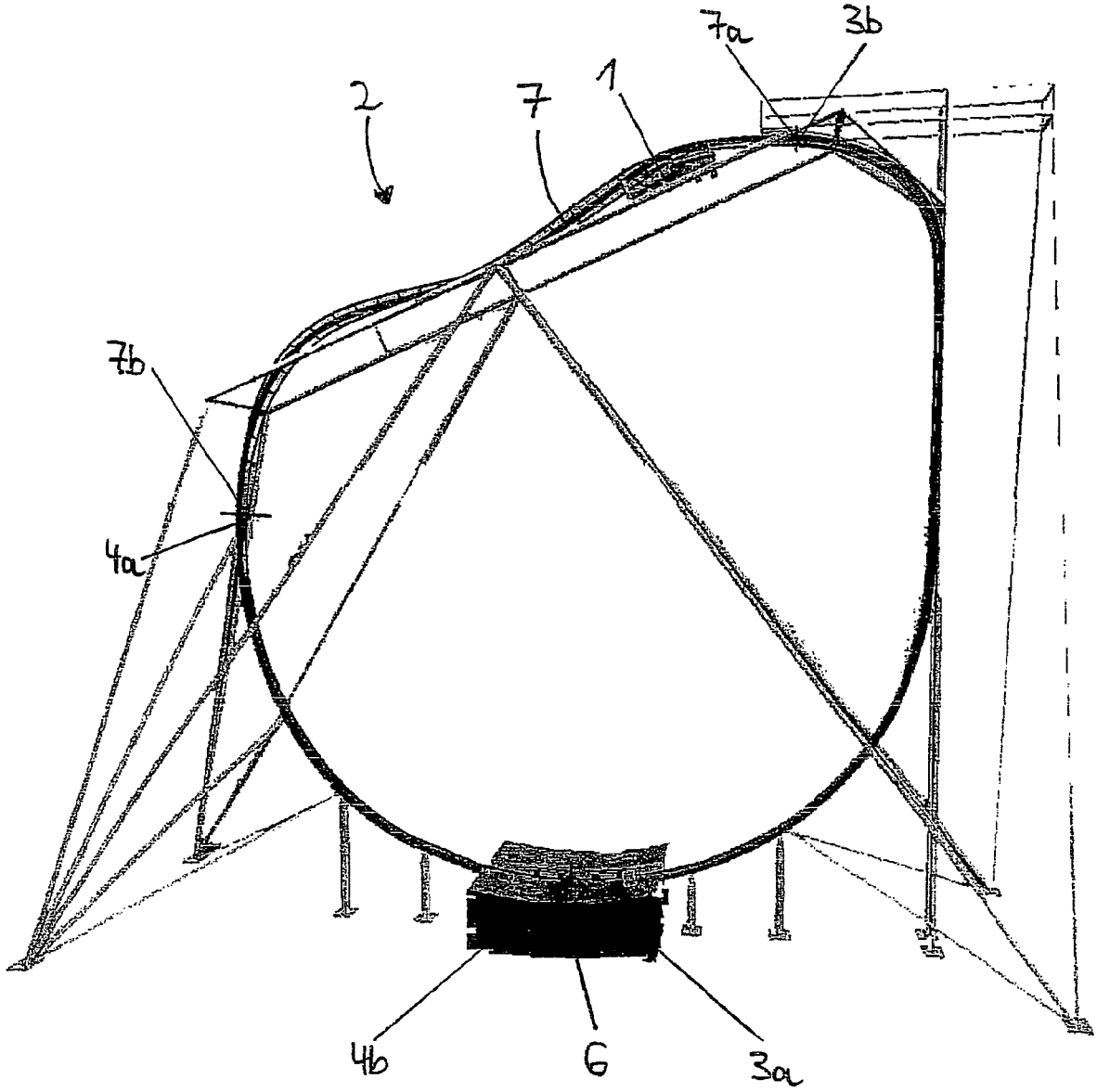
FIG. 2 shows a first modification of the fun-ride in accordance with the invention.

FIG. 2 represents a modification of the fun-ride in accordance with the invention. Here there is a connecting section 7 additionally in the lap configuration between the top end 3*b* of the first section 3 and the top end 4*a* of the second section 4. At the end points 7*a* and 7*b* of the section 7 the same is connected with the sections 3 and, respectively, 4.

In the present case the connecting section 7 is so twisted that the vehicle 1 during the ride along the connecting section 7 is laterally turned in a plane perpendicular to the ride direction through approximately 360 degrees. Accordingly in this section 7 the vehicle performs a corkscrew motion. This corkscrew motion that the vehicle 1 during the ride in the connecting section 7 is laterally tilted and will perform one turn about its longitudinal axis. This additional element increases enjoyment of the ride and offers additional possibilities of making the ride more interesting without additional space being required. FIG. 2 shows one example for simple expansion of the fun-ride using a special element. For such enlargement other guide elements may be integrated in a similar fashion into the lap configuration 2 without the basic principle and its properties being changed.

In the bottom portion of the lap section 2 a station 6 is provided for the passengers to alight and disembark.

In the figures the guide element is diagrammatically shown as a three membered rail with a center support tube and two rail tubes, which are connected with the support tube by way of struts. However, all other currently employed designs of element may be used for the vehicle 1 to run on.

Figure 3:
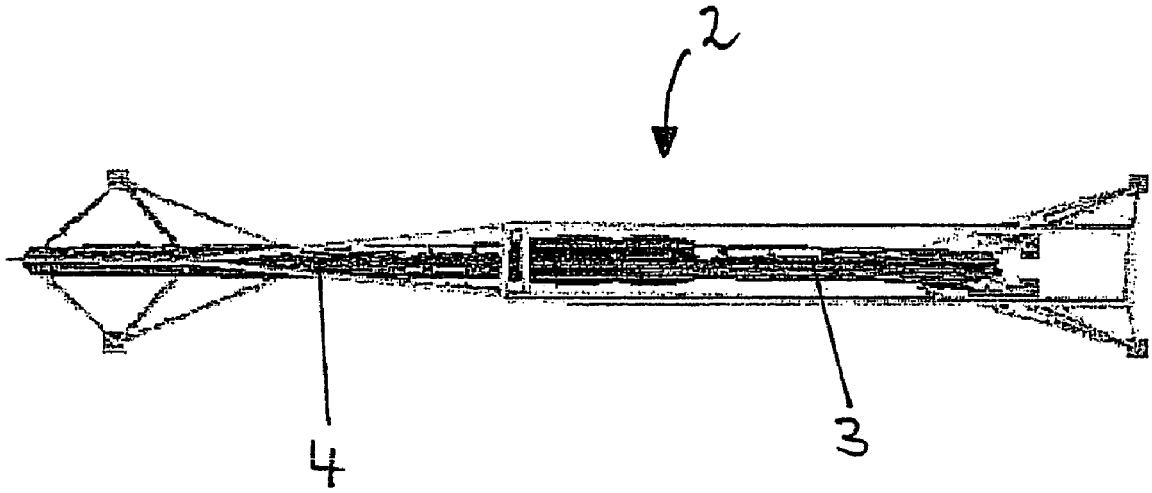
FIG. 3 is a plan view of the fun-ride.

In FIG. 3 the plan of the track 2 in accordance with FIG. 1 is illustrated in a bird's eye view together with the already described components. The figure serves to show the dimensionally extremely compact arrangement on a small area. The system is characterized by a high economic performance, since the space requirement is extremely small. Owing to the compact construction there is a cost optimum for the steel structures.

Figure 4:
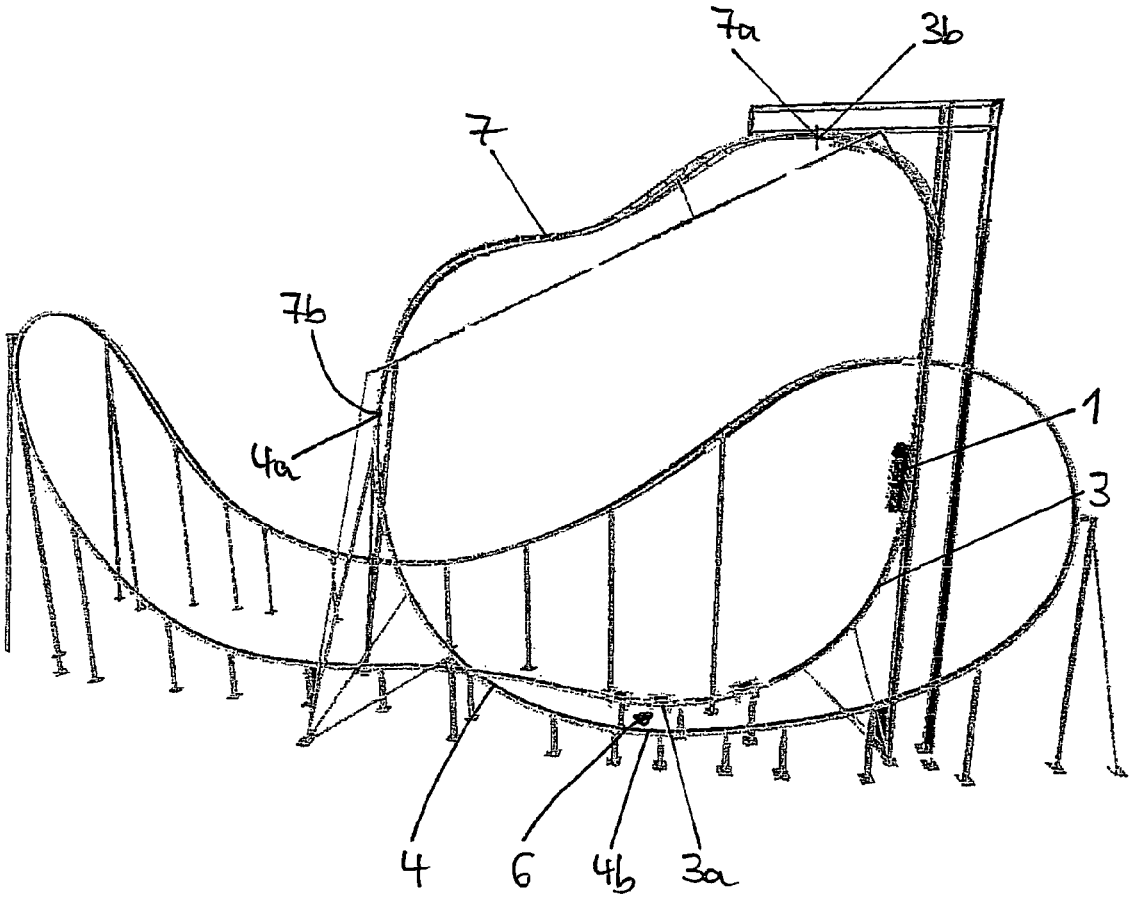
FIG. 4 shows one particular design of the fun-ride in accordance with the invention.

FIG. 4 shows an other working example, in which the basic element 2 in accordance with FIG. 2 is integrated in a track configuration with further elements. For this purpose the bottom end 3*a* of the first section 3 and the bottom end 4*b* of the second section 4 are offset in relation to each other. The further track extent adjoins these ends 3*a* and 4*b*, there again being a closed design of the lap. The means of the invention may therefore be a part of a closed track of a fun-ride.

Figure 5:
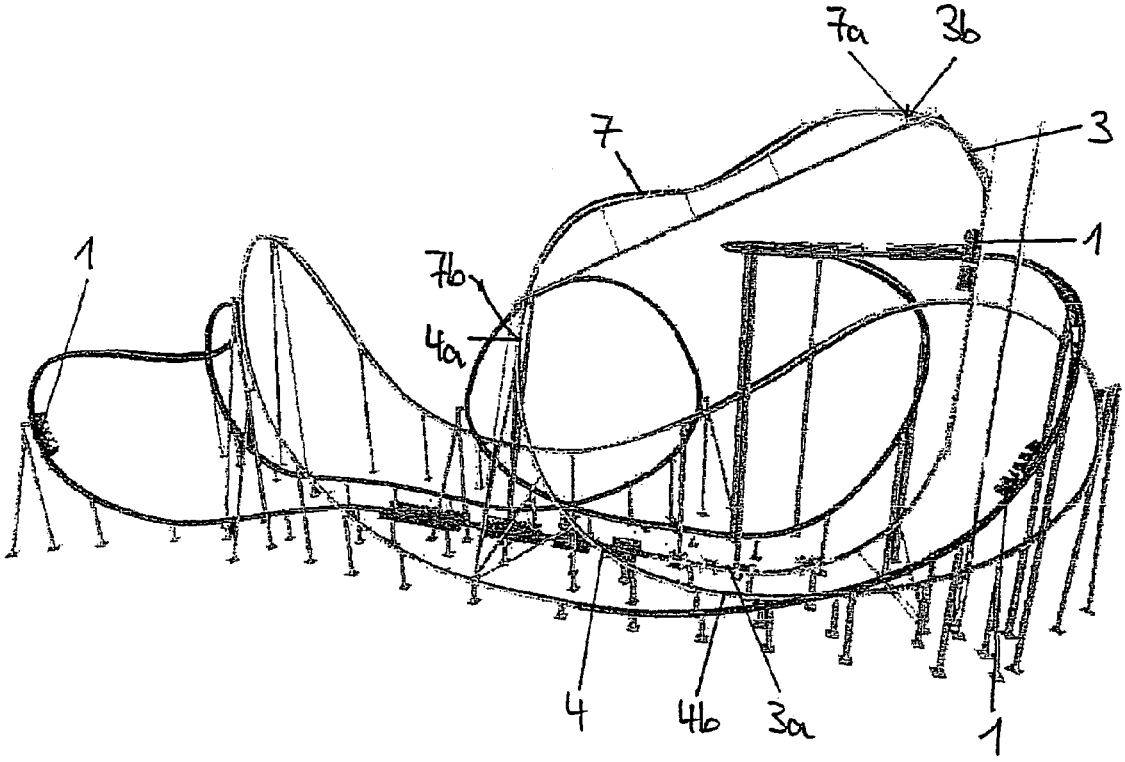
FIG. 5 shows a further embodiment of the fun-ride of the invention.

Another enlargement of the system is illustrated in FIG. 5. The basic element in accordance with the invention is in this case practically integrated in a roller coaster with a complex track configuration. Again the rail strand is the station 6. An additional rail strand with further ride elements is added. Since otherwise a substantial reduction in capacity owing to the extended ride time is then to be expected, capacity may be increased by having several vehicles 1 simultaneously on the lap. Then a block system and a brake in front of the station should be added in order to ensure safe operation.

The invention claimed is:

1. A fun-ride, more particularly for amusement parks, festivals and the like, comprising at least one rail vehicle (1) and a guide lap for the vehicle (1) with a lap section (2), which in a lateral projection essentially constitutes a loop, the lap section (2) having a first ascending section (3) and a second descending section (4) the top ends of the sections being connected together, said vehicle (1) being arranged to ride along the side, facing the inner side of the loop, of the sections (3 and 4), means (5) for engagement with the vehicle (1) positioned at a stationary location along at least a portion of the first ascending section (3) to engage and hold the vehicle (1) after the vehicle's ascent of the first ascending section (3) has been slowed under the force of gravity and to impede the vehicle's descent of the first ascending portion (3), and transport means that cooperates with the vehicle (1) being held by the means (5) for engagement with the vehicle (1) to transport the vehicle along at least a portion of the guide lap.

2. The fun-ride as set forth in claim 1, characterized in that the lap section (2) is essentially arranged in a vertical plane.

3. The fun-ride as set forth in claim 1, characterized in that on transition (3*b* and 4*a*) from the first section (3) to the second section (4) the vehicle (1) is in an inverted position.

4. The fun-ride as set forth in claim 1, characterized in that the bottom end (3*a*) of the first section (3) and the bottom end (4*b*) of the second section are joined together so that the entire lap section constitutes a closed loop.

5. The fun-ride as set forth in claim 4, characterized in that the bottom end (3*a*) of the first section (3) and the bottom end (4*b*) of the second section (4) are laterally offset in relation to each other and the lap section (2) is integrated within a guide lap having further lap elements.

6. The fun-ride as set forth in claim 1, characterized in that the guide lap has a connecting section (7) between the first (3) and the second section (4), which is so twisted that the vehicle (1) during the ride along the connecting section (7) is turned laterally about an axis essentially parallel to the direction of the ride.

7. The fun-ride as set forth in claim 6, characterized in that the connecting section (7) is so twisted that the vehicle (1) during its ride along the section performs a corkscrew movement, more especially through 360 degrees in all.

8. The fun-ride as set forth in claim 1, characterized in that the first ascending section and the second descending section being arranged essentially parallel and being joined together by an arcuate section.

9. The fun-ride as set forth in claim 1, characterized in that the means (5) for engagement with the vehicle (1) is located in a portion in the ascending section (3), in which the vehicle (1) moves at a low speed or is halted.

10. The fun-ride as set forth in claim 1, characterized in that the means (5) for engagement with the vehicle (1) is arranged in the ascending section (3) in a portion, which is provided to ensure that the vehicle undergoes a change in the direction of the ride in the portion or just above it.

11. The fun-ride as set forth in claim 1, characterized in that the means (5) is arranged in a portion of the first section (3) which is essentially free of curvature.

12. The fun-ride as set forth in claim 1, characterized in that the means (5) is arranged in a portion of the first section (3) which extends essentially vertically upward.

13. The fun-ride as set forth in claim 1, characterized in that the fun-ride comprises a conveyor means and the means (5) is arranged in the vicinity of such conveyor means or is at least functionally connected with such conveyor means.

14. The fun-ride as set forth in claim 1, characterized in that the means (5) is so designed such in the case of a reversal of the ride direction of the vehicle (1) it exerts a high braking action on the vehicle and on the other hand in the case of the downward movement of the vehicle (1) it exerts a small or no braking action.

15. The fun-ride as set forth in claim 1, characterized in that a station (6) is arranged in the bottom portion of the lap section.

16. The fun-ride as set forth in claim 15, characterized in that the station is arranged in a rail portion, which has a lap configuration dictated by ride dynamics.

17. The fun-ride as set forth in claim 1, characterized in that the means (5) for engagement with the vehicle (1) is a coupling device.

18. The fun-ride as set forth in claim 17, characterized in that the coupling device (5) is at least functionally connected with a transport means adapted to move the vehicle, after coupling with the vehicle (1), to the starting point (3*a*, 4*b* and 6) or, respectively, to a station (6).

19. The fun-ride as set forth in claim 1, characterized in that the means (5) of engagement with the vehicle (1) is a holding brake.

20. The fun-ride as set forth in claim 19, characterized in that the holding brake (5) is designed in the form of a brake which is self-locking during a downward movement of the vehicle (1).

21. The fun-ride as set forth in claim 19, characterized in the holding brake (5) is so designed that it is only actuated when it is supplied with force or energy.

22. The fun-ride as set forth in claim 19, characterized in that the holding brake (5) is so designed that even after cessation of the actuating force or energy it only opens when it is unloaded.

23. A fun-ride, more particularly for amusement parks, festivals and the like, comprising at least one rail vehicle (1) and a guide lap for the vehicle (1) with a lap section (2), which in a lateral projection essentially constitutes a loop, the lap section (2) having a first ascending section (3) and a second descending section (4), said vehicle (1) being arranged to ride along the side, facing the inner side of the loop, of the sections (3 and 4), a transport means for the transport of the vehicle along at least a section part of the guide lap, and a means (5) for engagement with the vehicle (1), the means (5) for engagement with the vehicle being a coupling means, characterized in that the top ends of the first ascending section (3) and a second descending section (4) being connected together, the transport means comprising a chain, and the coupling means being arranged at a location along the first ascending section (3) and comprising a chain hook that is compatible with the vehicle (1), wherein the coupling means is to be at least functionally connected with the transport means for coupling the vehicle (1) with the chain hook to the chain.

24. The fun-ride as set forth in claim 23, characterized in that the vehicle comprises an entrainment means arranged on the vehicle and/or a chain hook for coupling with the transport means.

25. The fun-ride as set forth in claim 24, characterized in that the transport means comprises an endless chain.

26. A method for the operation of a fun-ride comprising at least one rail vehicle (1), a guide lap for the vehicle (1) having a lap section (2) with a first ascending section (3) and a second descending section (4), whose top ends are connected together, said vehicle (1) being arranged to ride along the side, facing the inner side of the loop of the sections (3 and 4), a transport means for transport of the vehicle along at least one section part of the guide lap, and a means for engagement with the vehicle (1) being provided on the ascending section (3), the means (5) for engagement with the vehicle being a holding brake or a coupling means and being functionally coupled with the transport means, the method comprising the steps of:

transport of the vehicle from a starting point in the bottom portion of the lap section by means of a transport means upward;

release of the vehicle from the transport means;

downward movement of the vehicle under the action of gravity; and actuation of the means (5) for engagement with the vehicle (1) when the vehicle (1) is in the vicinity of the means (5) for engagement with the vehicle (1).

27. The method as set forth in claim 26, characterized in that the means (5) for engagement with the vehicle (1) is actuated when the vehicle in the vicinity of the means (5) is moved at a low speed or is halted.

28. The method as set forth in claim 26, characterized in that the vehicle (1) is braked essentially by the action of gravity to the low speed or to a halt in the ascending section (3).

29. The method as set forth in claim 26, characterized in that the means (5) for engagement with the vehicle (1) acts on the vehicle generally in the case of a change in the ride direction of the vehicle in the ascending section (3).

30. The method as set forth in claim 26, characterized in that the means (5) for engagement with the vehicle (1) acts during, just before or just after a ride direction change of the vehicle in the ascending section (3) on the vehicle (1).

31. The method as set forth in claim 26, characterized in that the means (5), irrespectively of whether it was actuated, during a downward movement of the vehicle (1) exerts no or only an extremely small braking force on the vehicle (1).

32. The method as set forth in claim 26, characterized in that the vehicle (1), after the actuation of the means (5) performs no or an extremely small downward movement.

33. The method as set forth in claim 26, characterized in that after release of the transport means under the influence of gravity the vehicle (1) pendulates between the first section (3) and the second section (4) at least once.

34. The method as set forth in claim 26, characterized in that after the release of the vehicle (1) from the transport means in addition to gravity drives and/or brakes act on the vehicle (1) in order to accelerate and/or to brake the vehicle (1).

35. The method as set forth in claim 26, characterized in that the means (5) is activated in order to act during the next halt or, respectively, the next downward motion of the vehicle (1) in that portion, in which the means (5) is arranged.

36. The method as set forth in claim 26, characterized in that the vehicle after actuation of the means (5) is moved downward to the starting point (3*a*, 4*b* and 6) or, respectively, to a station (6).

37. The method as set forth in claim 26, characterized in that after actuation of the means (5) the vehicle (1) is farther transported upward at least as far as the entry of the vehicle (1) to the second section (4) or, respectively, to a connecting section (7) between the top end (3*b*) of the first section and the top end (4*a*) of the second section (4) by a transport means.

38. The method as set forth in claim 26, characterized in that the vehicle (1) in the transition portion between the first section (3) and the second section (4) or, respectively, in the connecting section (7) is aligned in the inverted position, in which the heads of the passengers of the vehicle (1) are directed downward.

39. The method as set forth in claim 26, characterized in that the vehicle (1) is laterally tilted on passage through the connecting section (7).

40. The method as set forth in claim 39, characterized in that the vehicle (1) performs a corkscrew movement, and more especially a lateral turn through approximately 360 degrees in all.

41. The method as set forth in claim 26, characterized in that as a means (5) for engagement with the vehicle (1) a coupling device is provided.

42. The method as set forth in claim 41, characterized in that the coupling device (5) couples during, just before or just after a ride direction change of the vehicle in the ascending section (3) with the vehicle (1).

43. The method as set forth in claim 41, characterized in that the coupling device (5) is at least functionally connected with a transport means, which after coupling to the vehicle (1) moves the vehicle (1) to the starting point (3*a*, 4*b* and 6) or, respectively, to a station (6).

44. The method as set forth in claim 41, characterized in that the coupling device (5) is at least functionally connected with a transport means and the coupling device (5) couples with the vehicle (1) at a point in time at which the speed of the transport means and of the vehicle (1) are approximately equal.

45. The method as set forth in claim 26, characterized in that as a means (5) for engagement with the vehicle (1) a holding brake is provided.

46. The method as set forth in claim 45, characterized in that the holding brake (5) only opens after cessation of the actuating force or energy when it is unloaded.

47. The method as set forth in claim 45, characterized in that the holding brake (5) acts in self-locking manner after its activation during a downward movement of the vehicle (1).

* * * * *